United States Patent [19]

Smith

[11] 4,208,756

[45] Jun. 24, 1980

[54] CHIMNEY CLEANER

[76] Inventor: Samuel C. Smith, 210 Hartman Rd., Newton Centre, Mass. 02159

[21] Appl. No.: 910,734

[22] Filed: Jul. 31, 1978

[51] Int. Cl.[2] ..... F23J 3/00
[52] U.S. Cl. ..... 15/243
[58] Field of Search ..... 15/162, 163, 242, 243

[56] References Cited

U.S. PATENT DOCUMENTS

| | | | |
|---|---|---|---|
| 213,472 | 3/1879 | Toyson | 15/243 |
| 423,268 | 3/1890 | Osgood | 15/243 |
| 1,500,886 | 7/1924 | Nelson | 15/243 X |

FOREIGN PATENT DOCUMENTS

| | | | |
|---|---|---|---|
| 162130 | 1/1949 | Australia | 15/243 |
| 82492 | 9/1953 | Norway | 15/163 |

*Primary Examiner*—Edward L. Roberts

[57] ABSTRACT

A chimney cleaning apparatus for the removal of soot from chimneys and flue pipes. The apparatus includes permanently installed brackets, pulleys and cords and an adjustable frame supporting a sandbag scraping means and a soot collection bag attached to said frame for each cleaning. The apparatus functions upwardly and downwardly using the cord and pulley system, such that the operator may clean the chimney from its interior base opening.

6 Claims, 5 Drawing Figures

CHIMNEY CLEANER

BACKGROUND OF THE INVENTION

1. Field of the Invention

This invention pertains to devices for cleaning the interior sidewalls of chimneys and flue pipes having a scraper means that moves longitudinally up and down the chimney or flue pipe; a collection means to collect the soot scraped off the interior side walls; bracket means permanently installed at the top of the chimney and rope and pulley means to move the scraping and collection means vertically upward or downward.

2. Description of the Prior Art

Flues and chimneys should be cleaned at least every five years, but preferably more often. Due to the cost, and more often neglect, this task is usually overlooked until a problem develops. Statistics have shown that many fires are caused by ignition of flammable substances in soot.

Prior methods of chimney and flue cleaning are well known. One method of attending to the matter and at the same time spending little or no money is to drop a stuffed bag (weighted and held by a rope) down the flue. While this method is effective, it necessitates getting on top of the roof, at the risk of falling. In addition, the thought of saturating the house (even if care is taken) with soot is not a pleasant one.

Basically, every chimney cleaner should meet four basic criteria. It should have a scraping means. It should have a soot collection means. It should be simple to operate. It should be inexpensive.

Prior patents of some relevance are U.S. Pat. Nos. 1,777,815 and 1,390,831. U.S. Pat. No. 1,777,815 teaches an extremely complex device using a plurality of scrapers and a pulley and chain system to move the scrapers vertically upward and downward. A shaft with sprockets is used to accomplish this movement. A support plate is placed at the top of the chimney to support the apparatus. No soot collection means is provided. The entire apparatus must be installed and removed for each use.

U.S. Pat. No. 1,390,831 discloses an insertable and rotatable flue cleaner. It is difficult to see how this device can be fabricated to clean the full length of a chimney. It also has no soot collection means.

The apparatus of this invention enables the task of cleaning a chimney or flue pipe to be done from inside the house with a minimum of effort. It utilizes an adjustable scraper with a bag to catch and collect the soot. It also uses a bracket means permanently installed at the top of the chimney and a pulley means to enable any person to hoist the scraping means and soot collection means vertically upward and downward within the chimney. As a safety measure, a return rope is included.

The apparatus of the present inventions provides a scraping means, a soot collection means, a simple operational means, all in a device that is easy to use and inexpensive to manufacture. With such a device, chimneys can be cleaned frequently, at least once a year, with consequent energy saving and fire prevention.

SUMMARY OF THE INVENTION

The present invention pertains to a simple and inexpensive chimney cleaning apparatus. The first part of the apparatus is a scraping means and soot collection means. The scraping and soot collection means consists of a rectangular adjustable frame (for the average rectangular chimney), the frame having four perimeter segments, each segment having a formed lip to secure the upper edges of a sandbag. Adjustment means for each segment are provided by a slot and screw hole to permit segments to fit varying chimney dimensions. The adjustments need be made only once for a particular chimney. The sandbag, which is the scraping means, is secured to the outer perimeter of the adjustable frame. The soot bag, which is the soot collection means, is appropriately positioned at the underside of the adjustable frame such that soot loosened by the sandbag will fall inward and downward to the soot bag. Eyelets are appropriately positioned, especially at the corners of the adjustable frame to serve the dual purpose of holding the upward motion cords and the downward motion cords, which are joined at a respective common point for proper leveling of the frame before fastening the pulling cords.

Sharp corners and rough surfaces are purposely avoided at points where the cords contact the frame. Sleeving is also utilized. The sandbag scraping means is of a length equivalent to at least the maximum dimensions of the perimeter edges of the adjustable frame. At less than the maximum extension of the adjustable frame, a zippered end of the sandbag, in a flattened condition, is tucked under the terminal end of the sandbag. A perpendicular position is the result.

In instances in which the chimney cleaner of this invention will be custom made for a particular chimney, the frame will be of one solid, nonadjustable piece.

The sandbag scraping means is tapered inward to allow an easy flow of the scraped soot into the soot collection bag. The sandbag is made of heavy canvas or other suitable material.

The second major part of the chimney cleaner of this invention is is the bracket and pulley system. A bracket with mounted pulleys is permanently installed on the top of the chimney, (across two opposite corners). An operating cord is strung through the pulleys. The operating cord is inserted through a tube which is fastened to one corner of the chimney. At the base of the chimney required pulleys are appropriately placed for the continuation of the operating cord. This end of the operating cord is hooked onto the downward motion cord. The other end of the operating cord is hooked onto the upward motion cord, effecting a loop. The opposing sides of the adjustable frame are secured to their minimum operating vertical length, for both sets of opposing sides. The rope is marked to indicate the upper vertical extension. The sandbag is filled with sand and put in place on the frame. The soot bag is attached to the frame. The apparatus is now ready for use.

In operation, the chimney cleaning apparatus is moved upward by pulling the upward rope. During this motion, the surface of the sandbag and the metal lip of the frame scrape against the chimney wall, removing the soot. The loosened soot falls into the soot bag. At the end of the operation, the apparatus is detached from the pulling cord and a fireproof auxiliary extension cord is fastened to the ends of the pulley cord. The auxiliary cord remains in the chimney until the operation is again required.

The apparatus of this invention is extremely simple and it results in virtually no mess in chimney cleaning.

DESCRIPTION OF THE PREFERRED EMBODIMENT

Figure 1:
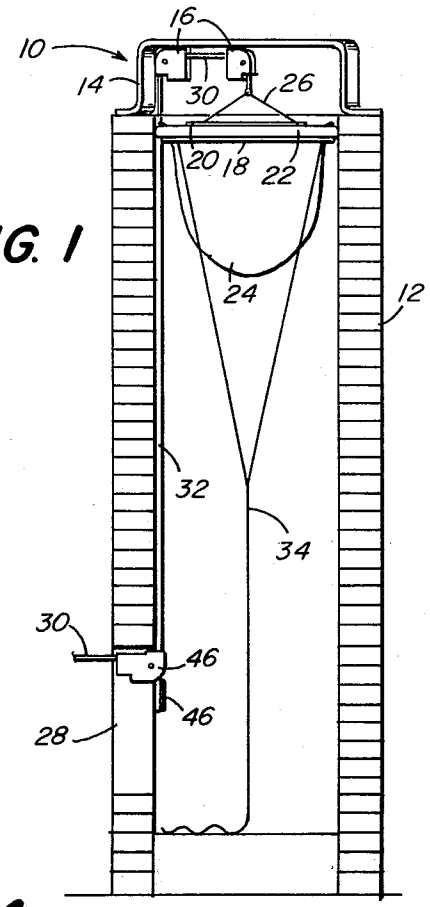
FIG. 1 is a cross-sectional view of a chimney with the chimney apparatus of this invention installed therein.

Referring now to the Figures, wherein like parts are referred to by like numbers throughout, the reference numeral 10 designates generally the chimney cleaner of this invention. FIG. 1 is a cross-sectional view showing chimney cleaner 10 installed in a typical chimney 12. A bracket 14 is permanently installed at the top of chimney 12 to support pulleys 16. A scraper frame 18 having horizontally extending outward lips 20 supports a sandbag scraping means 22 around its perimeter edges. A soot collection bag 24 is suspended vertically downward from scraper fram 18. Pulleys 46 are installed at the base and at opening 28 of chimney 12. A pull rope 30 (preferably fireproof) begins outward from exit pulley, through two other pulleys, extends upward through tube 32 to pulleys 16 where it is further extended to be secured to frame 18. A return rope is secured to the lower perimeter of frame 18 to pull frame 18 downward.

Figure 2:
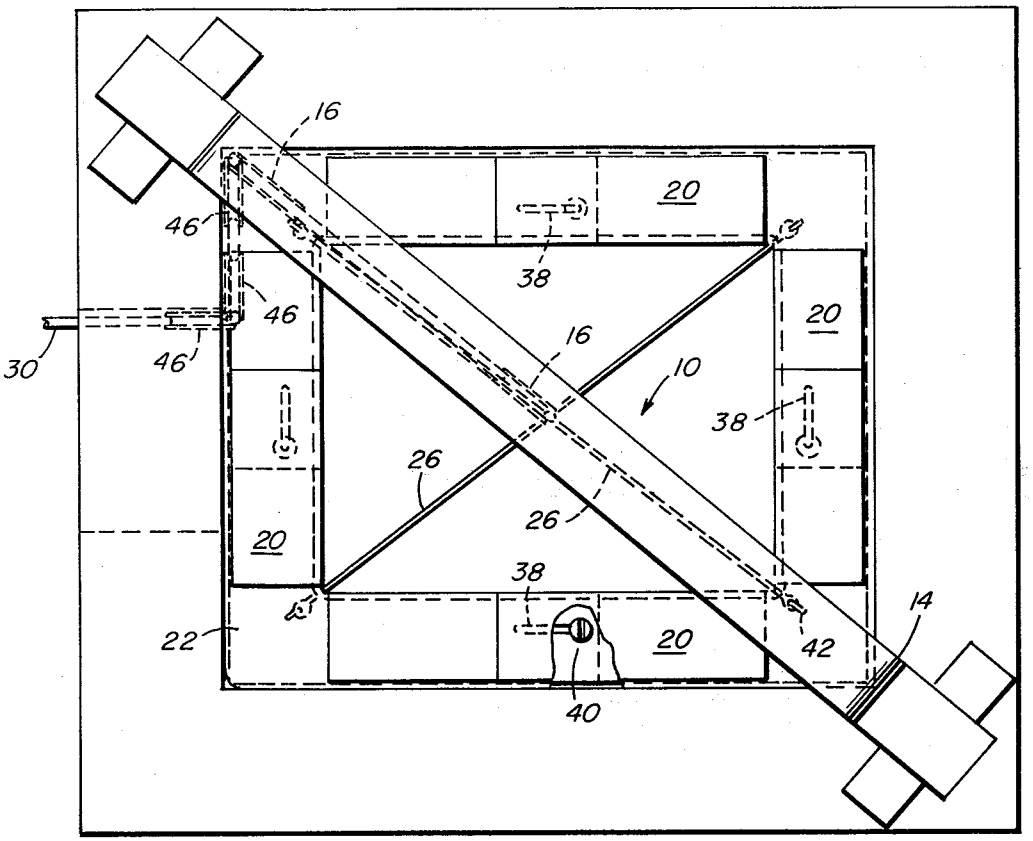
FIG. 2 is a top plan view of the adjustable frame of the chimney cleaning apparatus of this invention.

FIG. 2 is a top plan view of frame 18 which is fabricated from four adjustable segments forming its external perimeter. Each perimeter segment of adjustable frame 18 has a formed lip 20 to secure and support a sandbag scraping means 22. Each joining pair of segments of frame 18 has a screw hole 36 on its upper part and a slot 38 on the lower part, the purpose of which is to adjust the segment of the frame to hit a particular chimney. A screw 40 secures the segments in the desired position. This adjustment of frame 18 is made only once for each particular chimney. A soot collection bag 24 (FIGS. 1 and 3) is appropriately mounted on the underside of adjustable frame 18. Four eyelets 42 are positioned appropriately, preferably at the corners of adjustable frame 18. Eyelets 42 serve the dual purpose of holding the upward motion cords 26 as well as the downward motion cords 34. Cords 26 and 34 are joined at a respective common point for proper leveling of frame 18 for their fastening.

Figure 4:
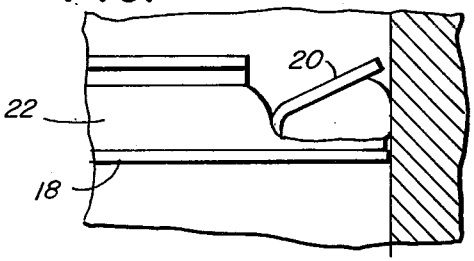
FIG. 4 is a side view of a corner of the frame-sandbag junction of the chimney cleaner of this invention.
Figure 3:
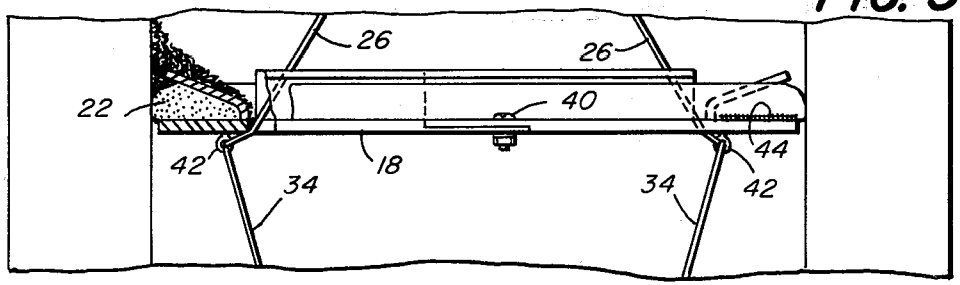
FIG. 3 is a side view of one perimeter edge of the chimney cleaner frame of this invention.

Sharp corners and rough surfaces are purposely avoided at the points where cord 26 contacts adjustable frame 18. Sleeving (not shown) may also be used. Sandbag scraping means 22 has a length equivalent to at least the maximum perimeter dimensions of adjustable frame 18. At less than the maximum extension of frame 18, a zippered end 44 of sandbag 22 in a flattened position is tucked under the end of sandbag 22 as shown in the detail view of FIG. 4. A perpendicular position is the result. Also, as shown in FIGS. 3 and 4, sandbag scraping means 22 is tapered inwardly to allow for easy flow of the scraped soot into soot collection bag 24, as shown in FIGS. 3 and 4. Sandbag 22 is positioned between the upward sloping lip 20 and the horizontal base of frame 18, also as shown in FIGS. 3 and 4.

Figure 5:
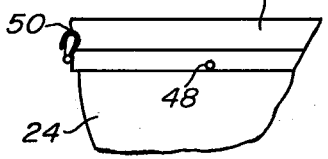
FIG. 5 is a partial cut-away view showing the attachment means for the detachable soot bag.

FIG. 5 illustrates the attachment means for detachable soot bag 24. As shown, hooks 50 are attached to sootbag 24 by means of eyelets 48 (a total of eight being required). When hooked, the uppermost part of sootbag 24 touches the underside of frame 18. Frame 18 supports and secures sandbag 22 in such a manner as to cause the outer peripheral surface of sandbag 22 to apply pressure against the chimney wall, thereby removing the soot in a scraping manner. More specifically, sandbag 22 is retained or secured by positioning between the platform of frame 18 and lip 20.

There will be many instances in which a chimney cleaner 10 will be custom fabricated for a particular chimney 12. In such instances frame 18 will be one solid, non-adjustable piece.

INSTALLATION AND OPERATION

A bracket 14 with mounted pulleys 16 (FIG. 1) is permanently installed on the top of chimney 12 and the operating motion cord 30 is inserted through vertical tube 32 secured to a corner of chimney 12. At the base opening 28 of chimney 12, a pulley 46 is appropriately positioned for the continuation of operating cord 31. This end of operation cord 30 is secured to downward motion cord 34. The other end of operating cord 31 is hooked to scraper (FIGS. 2 and 3), effecting a loop. Then one set of opposed sides of frame 18 is adjusted to its minimum position. The other set of opposed sides of frame 18 is then adjusted. The frame 18 is tested. The cords are marked to indicate their top limits.

The sandbag 22 is adequately filled with sand and put in place. The soot bag 24 is attached. Chimney cleaner 10 is now ready for operation.

In operation, chimney cleaner 10 is moved vertically upward by pulling upward cord 30. During this upward motion, the surface of sandbag 22 and the edge of metal lip 20 rub against the interior wall of chimney 12, scraping the soot therefrom. The loose soot falls into the soot bag 24.

The operation is simple and results in virtually no mess in the room.

At the end of the operation, the frame 18 of chimney cleaner 10 is detached from the pulling cord 30, and an auxiliary cord (not shown) which is fireproof, is fastened to the ends of pulling cord 30. The auxiliary cord remains in the chimney 12 until the cleaning operation is again required. Thus, the pulling cord 30 is saved from constant exposure to heat. For long life and reliability this is desirable, even though pulling cord 30 may be fireproof.

While I have illustrated and described herein one embodiment of my invention, other embodiments and modifications may occur to those skilled in the art. My novel invention is covered by the scope of the appended claims.

I claim:

1. A chimney cleaner for scraping the soot from the interior sidewalls of a chimney comprising:

an open frame of generally rectangular shape contoured to fit the interior dimensions of the chimney;

an upward sloping lip secured to said frame and extending to its outer perimeter edges;

a sandbag secured between the base of said frame and said upper lip, and extending around the outer peripheral edges of said frame; a portion of said sandbag extending outwardly beyond said lip and frame to define a scraping surface;

a soot collection bag secured to the underside of said frame; and means to raise and lower said chimney cleaning apparatus vertically within a chimney.

2. The apparatus of claim 1 wherein said frame further includes four side segments forming its perimeter and each of said perimeter segments further comprises:

two extensible sections;

a slot in one of said sections;

a screw hole and screw to adjust the length of said perimeter segments.

3. The apparatus of claim 1 wherein said sandbag further includes:

a zippered opening at one end for the insertion of sand.

4. The apparatus of claim 1 wherein said soot collection bag is detachable from said frame.

5. The apparatus of claim 1 wherein said means to raise and lower said chimney cleaning apparatus comprises:

a bracket permanently secured to the top of said chimney;

a first pulley secured to said bracket centrally;

a second pulley secured to the corner sidewall of said chimney;

a tube extending vertically downward from said second pulley along the vertical corner of said chimney to its base opening;

a third pulley at the base of said tube;

a pull cord extending from outside the base of said chimney, through said third pulleys, through said tube through said second and first pulleys to a central junction point of said frame;

said junction point cords being secured to said frame through eyelets.

6. The apparatus of claim 1 further including a cord secured to the base of said soot bag for pulling said soot bag downward, said cord being looped for connection to said pull cord.

* * * * *